US006139110A

United States Patent [19]

Jeng

[11] Patent Number: 6,139,110

[45] Date of Patent: Oct. 31, 2000

[54] REINFORCED CANTILEVER BENCH

[75] Inventor: Chary Jeng, City of Industry, Calif.

[73] Assignee: Berkeley Products, Inc., City of Industry, Calif.

[21] Appl. No.: 09/330,295

[22] Filed: Jun. 11, 1999

Related U.S. Application Data

[63] Continuation-in-part of application No. 29/091,723, Aug. 5, 1998.

[51] Int. Cl.[7] ..... A47C 7/02

[52] U.S. Cl. ..... 297/452.39; 297/445.1; 297/452.18; 297/452.29; 297/452.63

[58] Field of Search ..... 297/452.63, 452.29, 297/452.39, 452.18, 445.1

[56] References Cited

U.S. PATENT DOCUMENTS

| | | | |
|---|---|---|---|
| 398,179 | 2/1889 | Parry et al. | 297/452.63 |
| 1,886,308 | 11/1932 | Schultes | 297/452.63 |
| 3,117,775 | 1/1964 | Hamilton et al. | 297/452.63 |
| 3,203,734 | 8/1965 | Seymer | 297/452.63 |
| 3,271,076 | 9/1966 | Smith | 297/452.63 |

*Primary Examiner*—Anthony D. Barfield
*Attorney, Agent, or Firm*—Frank Frisenda

[57] ABSTRACT

A wooden bench having a reinforced metal frame is provided. The reinforced bench comprises a metal back support frame section of unitary construction and a pair of curvalinear metal side support frame sections of unitary construction. The side frame section comprises a top arm rest support member and a bottom base support member, and a plurality of curved longitudinally aligned stiffening ribs. The stiffening ribs each have an upright leg portion and an upper arcuate portion outwardly flared to form a winged arm rest support.

1 Claim, 3 Drawing Sheets

REINFORCED CANTILEVER BENCH

CROSS-REFERENCE TO RELATED APPLICATION

The above-identified application is a continuation-in-part of pending application, Ser. No. 29/091,723, entitled: COMBINATION BENCH, filed by the applicant on Aug. 5, 1998.

BACKGROUND OF THE INVENTION

The present invention relates to an improved construction of a wooden bench, and more particularly, to a wooden bench with metal reinforced back and sidearms sections.

With the advent of increasing leisure time, outdoor lawn and garden entertainment continues to gain popularity, thus increasing the desire for attractive yet durable outdoor furniture. To supply such furniture to a growing market in a cost efficient, convenient manner, ready to construct and easy to knock down furniture has become a demanded necessity. The desirability of ready to assemble furniture components is based upon lower attendant shipping and storage costs for the wholesaler and retailer.

One drawback of many conventional easy to knock down furniture constructions is the tendency of such furniture components to lose their assembled integrity over time and normal wear. This is particularly experienced in arm supports for outdoor furniture such as wooden benches.

A wide variety of bench construction are known in the art, for instance, as disclosed in U.S. Pat. No. 3,117,775 issued Hamilton, et al.; U.S. Pat. No. 3,203,734 issued to Seymer; U.S. Pat. No. 3,511,536 issued to Suzuki; U.S. Pat. No. 3,203,734 issued to Seymer; U.S. Pat. No. 3,271,076 issued to Smith; and U.S. Pat. No. 4,113,312 issued to Skalka.

Those skilled in the art, however, have recognized a significant need for durability and attractiveness of the outdoor furniture in this market. The present invention fulfills these needs.

SUMMARY OF THE INVENTION

A wooden bench having a reinforced metal frame is provided. The reinforced bench comprises a metal back support frame section of unitary construction and a pair of curvalinear metal side support frame sections of unitary construction. The side frame section comprises a top arm rest support member and a bottom base support member, and a plurality of curved longitudinally aligned stiffening ribs. The stiffening ribs each have an upright leg portion and an upper arcuate portion outwardly flared to form a winged arm rest support.

In a presently preferred embodiment, the unique reinforced wooden bench comprises a metal back support frame section of unitary construction having an arched top support member, a bottom support member and an end post disposed at each side and joined with the top and bottom support members. The support member includes a plurality of integral laterally spaced throughbores for receiving means to secure wooden bench components to the back support frame section.

A pair of curvalinear metal side frame sections of unitary construction each comprise a top armrest support member and a bottom base support member. The metal side frame section further include a plurality of stiffening ribs and an intermediate crossbar. The stiffening rib comprises a substantially linear lower portion and an upper arcuate portion extending beyond the bottom base support member to form a winged arm rest support.

The present invention thus provides a durable and attractive bench construction that is easy to knock down and convenient to assemble.

DETAILED DESCRIPTION OF THE PREFERRED EMBODIMENTS

A wooden bench having a reinforced metal frame is provided. The reinforced bench comprises a metal back support frame section of unitary construction and a pair of curvalinear metal side support frame sections of unitary construction. The side frame section comprises a top arm rest support member and a bottom base support member, and a plurality of curved longitudinally aligned stiffening ribs. The stiffening ribs each have an upright leg portion and an upper arcuate portion outwardly flared to form a winged arm rest support.

In a presently preferred embodiment, the unique reinforced wooden bench comprises a metal back support frame section of unitary construction having an arched top support member, a bottom support member and an end post disposed at each side and joined with the top and bottom support members. The support member includes a plurality of integral laterally spaced throughbores for receiving means to secure wooden bench components to the back support frame section.

A pair of curvalinear metal side frame sections of unitary construction each comprise a top armrest support member and a bottom base support member. The metal side frame section further include a plurality of stiffening ribs and an intermediate crossbar. The stiffening rib comprises a substantially linear lower portion and an upper arcuate portion extending beyond the bottom base support member to form a winged arm rest support.

The present invention thus provides a durable and attractive bench construction that is easy to knock down and convenient to assemble.

Figure 1:
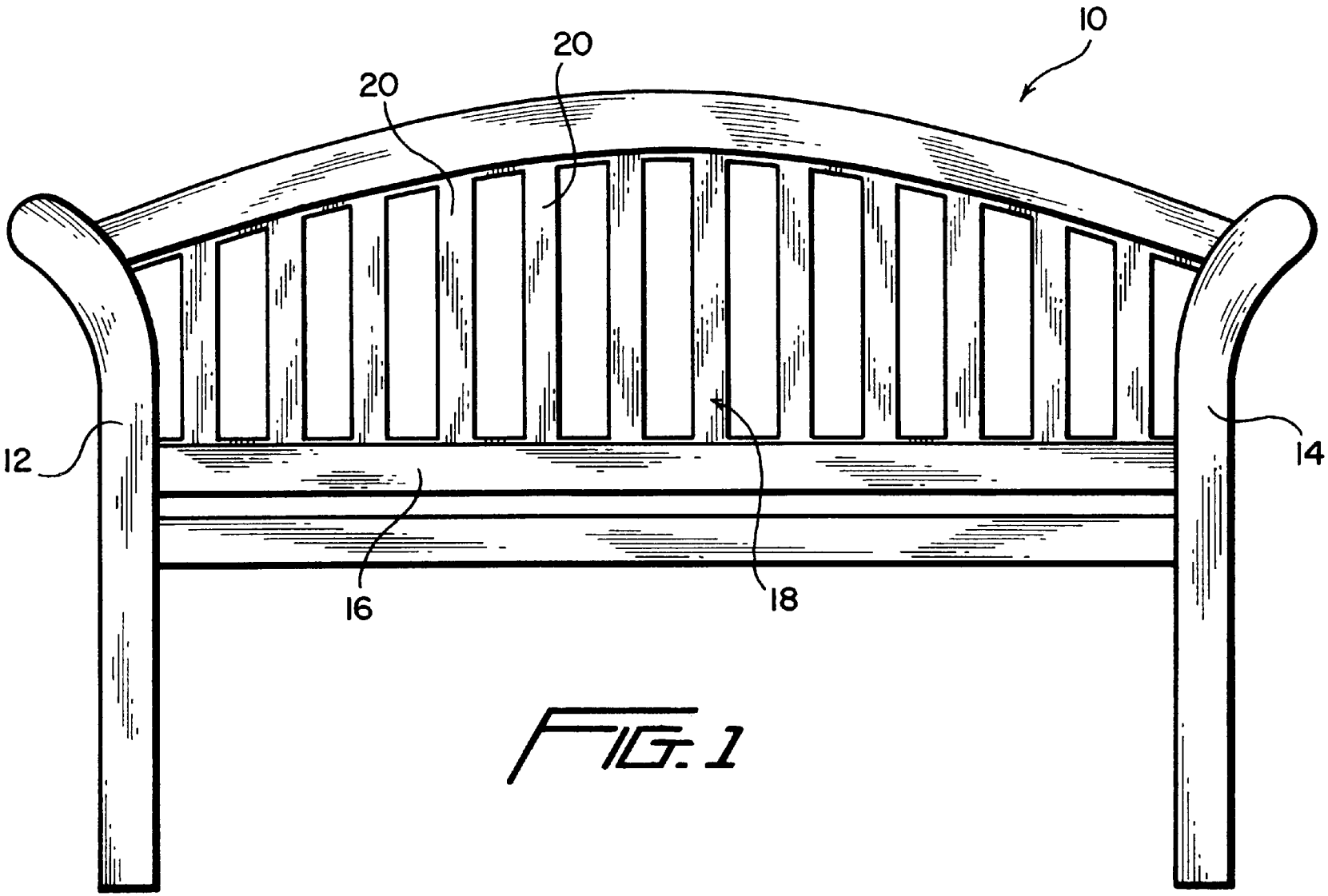
FIG. 1 is a front view of one embodied form of the reinforced cantilever bench in accordance with the present invention.
Figure 2:
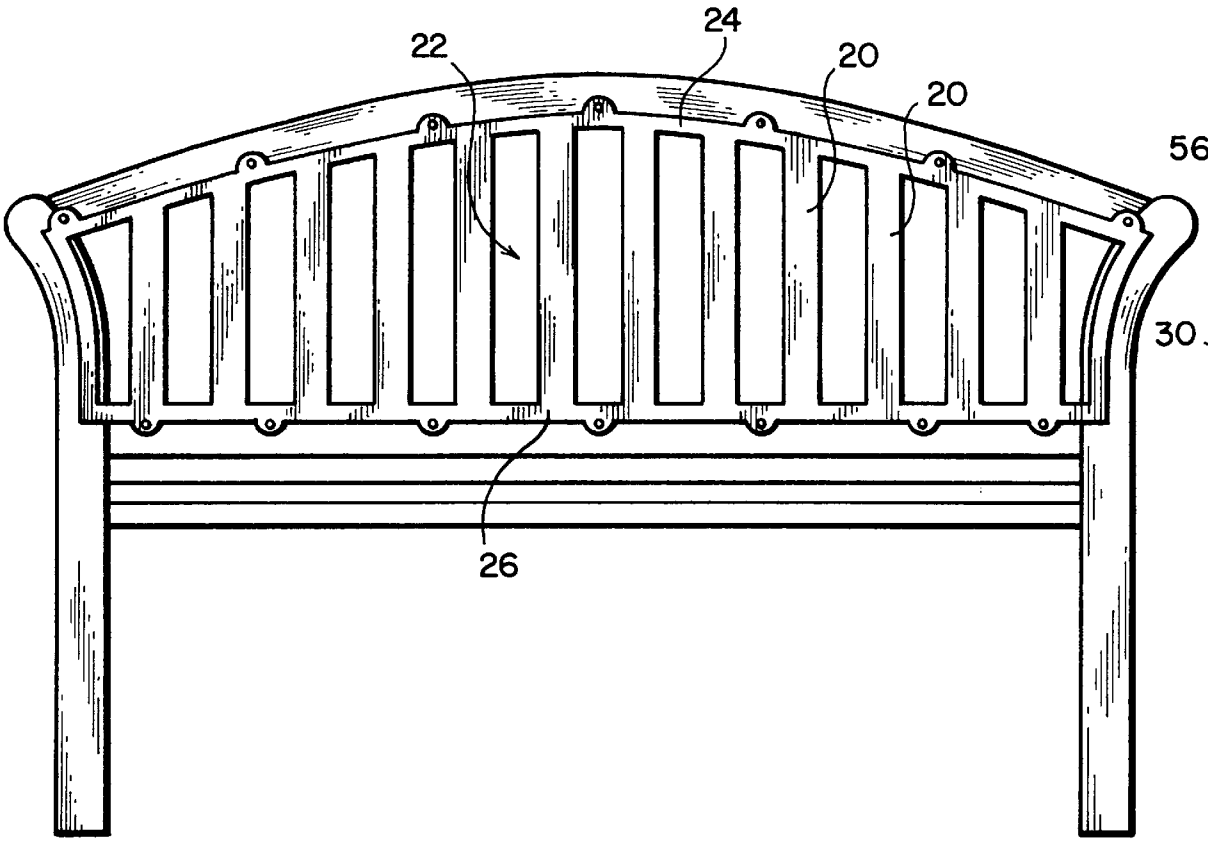
FIG. 2 is a rear view of one embodied form of the reinforced cantilever bench depicting the metal back support frame in further detail.

As shown in FIGS. 1 and 2, there is depicted a wooden reinforced bench 10 comprising a left side arm 12 and right side arm 14. The bench backrest 16 includes a one-piece metal back support frame section 18. In more detail, the metal back support frame section 18 comprises a plurality of parallel spaced metal slats 20 joined within an outer metal frame 22 having an arched top support member 24 and a bottom support member 26.

Figure 3:
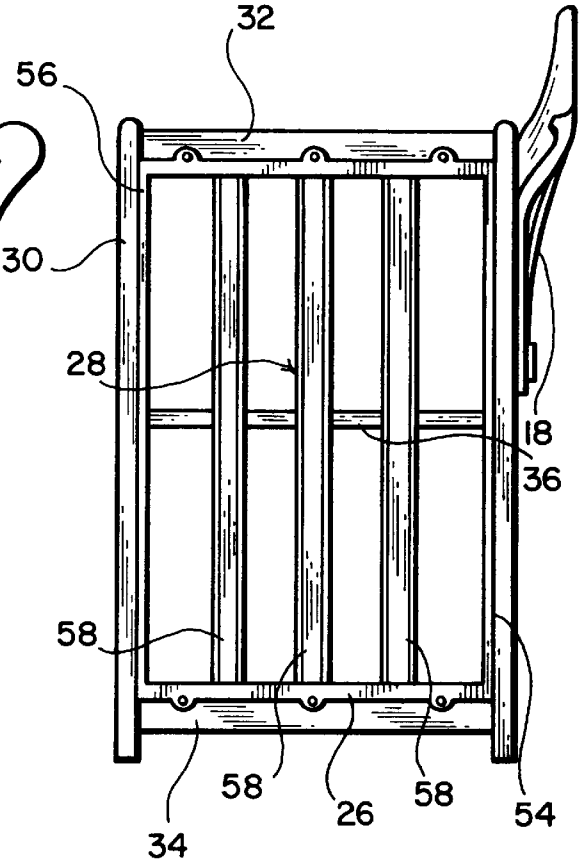
FIG. 3 is a side view of one embodied form of the reinforced cantilever bench shown in FIG. 1 depicting the curvalinear metal side support frame in further detail.

As shown most clearly in FIG. 3, one-piece curvalinear metal side frame section 28 is fixedly disposed at each end and perpendicular to the metal back support frame section 18. The curvalinear metal side frame section 28 provides a cantilever balanced spine for receiving the wooden components 30, 32, and 34 forming the base and completing the winged arm rest portions 38 of the inventive bench. A metal cross bar 36 is disposed at a mid-section of the curvalinear arm support member 28 for receiving the ends of a plurality of spaced wooden slats 40, 42, 44, 46, 48 and 50 forming the seat portion of the inventive bench. See FIG. 4. A plurality of intermediate stiffening rigs 52*a, b*, and *c* reinforce the cantilevered side arm 12. Side frame and posts 54 and 56 are provided at each edge of the curvalinear support member 28.

Figure 4:
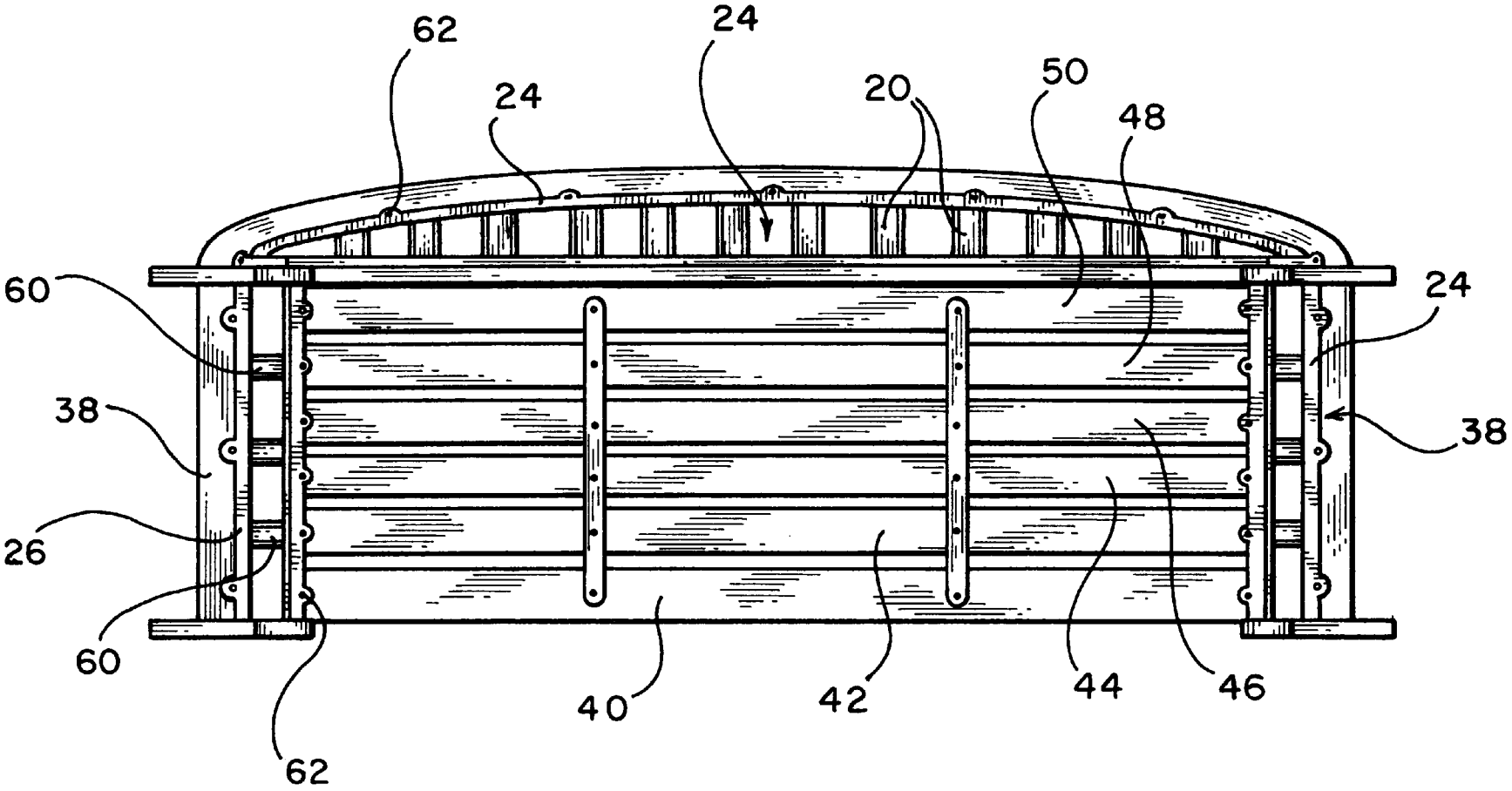
FIG. 4 is a bottom view of the reinforced cantilever bench shown in FIG. 1 further depicting the side frame with outwardly flared stiffening ribs.

FIG. 4 depicts the underside of the reinforced cantilever bench 10. As shown, the metal back support frame section 24 is formed by a plurality of parallel spaced slats 20 joined within an outer metal frame 54 having a top support member 24 and a bottom support member 26 that traverses the distance between the two winged side arms 38.

As further shown by references to FIGS. 3 and 4, the stiffening ribs 52 of the curvalinear metal side frame section 28 each have a substantially vertical lower leg 58 and an upper arcuate portion 60 extending beyond the bottom base support member 26.

The metal frame sections 24 and 26 comprise integral mounting means 62 such as a series of nuts and bolts with complimentary sized throughbores provide for convenient fixation of the wooden components to the balance metal spine of the inventive bench.

While oak, teak, rosewood and mahogany are preferred for fabricating the wooden components of the inventive bench, any suitable wood having durability and weather resistance characteristics can be used for the bench construction. Iron, aluminum or any suitable metal may be used for fabricating the metal components of the reinforced bench.

The foregoing descriptions and drawings should be considered as illustrative only of the principles of the invention. Since numerous applications of the present invention will readily occur to those skilled in the art, it is not desired to limit the invention to specific examples disclosed or the exact construction and described. Rather, all suitable modifications and equivalents may be resorted to, falling within the scope of the invention.

I claim:

1. A wooden bench having a reinforced metal frame comprising in combination:

(a) a wooden base bench comprising a left side arm, right side arm, backrest and seat portion reinforced and joined with a metal back support frame section and a pair of curvalinear metal side frame sections;

(b) the metal back support frame section being of unitary construction having an arched top support member, a bottom support member and an end post disposed at each side and joined with said top and bottom support members; said support members comprising a plurality of integral laterally spaced throughbores for receiving means to secure wooden bench components to said back support frame section; and (c) the pair of curvalinear metal side frame sections being of unitary construction each comprising a top armrest support member and a bottom base support member, a plurality of stiffening ribs and an intermediate crossbar, said support members comprising a plurality of integral throughbores for receiving means to secure wooden bench components to said side frame section; each of said stiffening ribs has a substantially vertical lower portion and an upper arcuate portion extending beyond said bottom base support member.

* * * * *